United States Patent [19]

Syrigos

[11] Patent Number: 4,673,945

[45] Date of Patent: Jun. 16, 1987

[54] BACKFIRE ANTENNA FEEDING

[75] Inventor: Harry Syrigos, Malden, Mass.

[73] Assignee: Alpha Industries, Inc., Woburn, Mass.

[21] Appl. No.: 653,457

[22] Filed: Sep. 24, 1984

[51] Int. Cl.[4] ..... H01Q 19/10

[52] U.S. Cl. ..... 343/755; 343/785; 343/840

[58] Field of Search ..... 343/840, 783, 785, 781 CA, 343/753, 781 R, 755

[56] References Cited

U.S. PATENT DOCUMENTS

| | | | |
|---|---|---|---|
| 3,071,770 | 1/1963 | Wilkes | 343/840 |
| 3,611,391 | 10/1971 | Bartlett | 343/785 |
| 3,611,392 | 10/1971 | Knox | 343/783 |
| 4,506,265 | 3/1985 | Dumas et al. | 343/840 |

FOREIGN PATENT DOCUMENTS

| | | | |
|---|---|---|---|
| 2240893 | 3/1974 | Fed. Rep. of Germany | 343/840 |
| 973583 | 10/1964 | United Kingdom | 343/840 |
| 390605 | 11/1973 | U.S.S.R. | 343/781 CA |

*Primary Examiner*—Eli Lieberman
*Assistant Examiner*—Michael C. Wimer
*Attorney, Agent, or Firm*—Charles Hieken

[57] ABSTRACT

A backfire feed antenna has a parabolic reflector with a ring-focus at the reflector focal point comprising a dielectric waveguide having a stem portion and a cap portion with a pointed end and most of the stem portion inside a conducting tube along the axis of the parabolic reflector. The outer surface of the cap portion is concave outward and convex inward and covered with a conducting layer. A curve between a parabola and hyperbola defines the surface. The cap portion has a conical surface extending between an annular surface at the junction between the stem portion and the cap portion and an axially extending circumferential surface surrounding the conducting layer. The inside end of the dielectric waveguide is pointed.

8 Claims, 2 Drawing Figures

BACKFIRE ANTENNA FEEDING

The present invention relates in general to backfire antenna feeding and more particularly concerns novel apparatus and techniques for backfire feeding antennas at frequencies below 40 GHz, particularly at communication frequencies of 18, 23 and 35 GHz to combine high performance with small size with structure that is relatively easy and inexpensive to fabricate while maintaining electrical characteristics within FCC specifications.

One approach for providing a microwave antenna in this frequency range involves feeding a reflector with a prime focus scalar feed quadrastrut supported. To meet the lower standard B of FCC Standard Compliance Parts 21 and 94 with broader beamwidth, lower gain and higher acceptable side lobes as compared with Standard A, a reflector two feet in diameter is used. To meet Standard A with this prior art structure requires a reflector four feet in diameter with a shroud.

An article entitled "Backfire Feed Antenna Beats Cassegrain Design" by Harry Syrigos in MICROWAVE SYSTEMS NEWS for October 1983 describes a backfire feed antenna that combines high performance with small size for operation in the frequency range of 94 GHz. This article describes a ring-focus feed using a dielectric waveguide having a conical subreflector integrated with and at the open end of the dielectric feedline. Although that structure works well at 94 GHz, it was found not possible to merely scale the dimensions of that structure upward for the longer wavelengths at 35, 23 and 18 GHz.

It is an important object of this invention to provide an improved backfire feed antenna at microwave frequencies below 40 GHz.

According to the invention, a backfire feed antenna has a ring focus comprising a dielectric waveguide having a pointed internal end of a stem portion terminating in a cap portion at the external end with the stem portion concentrically seated in a conducting tube. The external end surface of the cap portion is coated with conducting material and defines a curve of revolution about the axis within the range between a parabola of revolution and a hyperbola of revolution that is a concave conducting surface facing outward and convex facing toward the reflecting surface along whose axis the ring focus is seated. The inner surface of the cap portion is conical, typically making an angle with the axis within the range of 40°-60°.

Numerous other features, objects and advantages of the invention will become apparent from the following specification when read in connection with the accompanying drawing in which.

Figure 1:
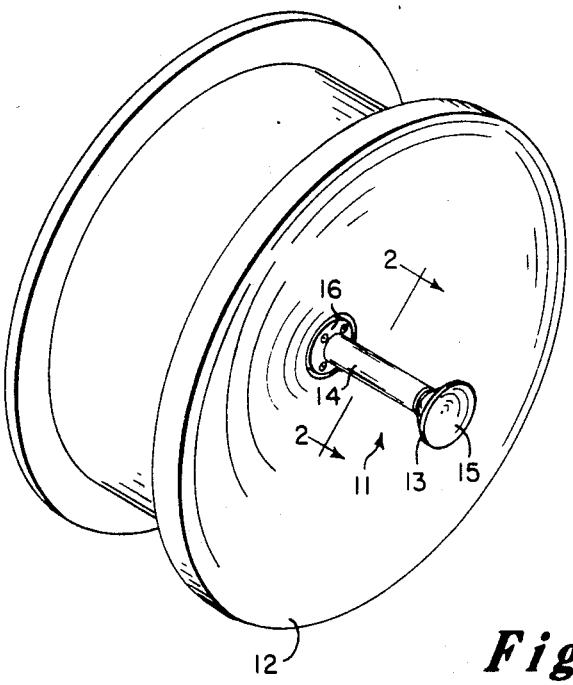
FIG. 1 is a perspective view of an embodiment of the invention with the backfire ring-focus feed centered along the axis of a parabolic reflector.

With reference now to the drawing and more particularly FIG. 1 thereof, there is shown a perspective view of an embodiment of the invention. A backfire ring-focus feed 11 illuminates a parabolic reflector 12 to meet the type A specifications of antennas operating at 19 GHz specified in part 21 and 46 of 47 C.F.R. § 21.108 when the reflector is only two feet in diameter. The ring-focus feed comprises a dielectric waveguide 13 seated in a conducting tube 14 and coated with conducting material 15 at the outside concave surface. A base 16 is screwed to appropriate supports in conventional manner, and there is a conventional feed for coupling the inside end of the dielectric waveguide 13 to waveguide coupled to transmitting and/or receiving equipment.

Figure 2:
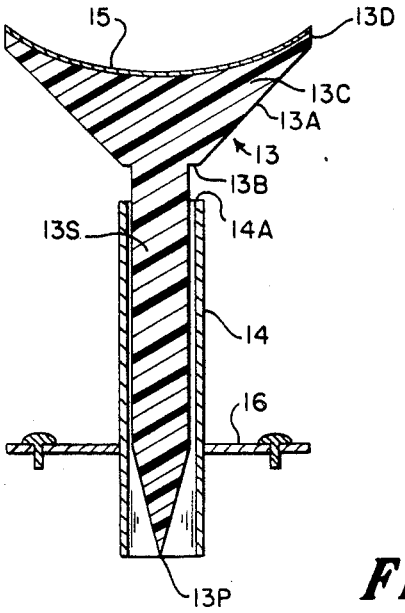
FIG. 2 is a sectional view through section 2—2 of FIG. 1.

Referring to FIG. 2, there is shown a sectional view through section 2—2 of FIG. 1 illustrating the structural arrangement of the novel dielectric waveguide element 13 generally having the shape of a golf tee. Dielectric waveguide element 13, typically made of Rexolite, has an outside cap portion 13C and a stem portion 13S having an internal pointed end 13P with most of stem 13S inside conducting tube 14. Cap portion 13C is coated with conducting metallic layer 15, typically aluminum. Layer 15 is concave outward, convex inward and defined by a curve between a hyperbola and a parabola, the specific curvature being selected experimentally to meet a desired beam width and sidelobe intensity for a particular parabolic reflector.

Cap 13C has a conical reflector-facing surface 13A typically forming an angle with a plane perpendicular to the axis and passing through the junction between stem portion 13S and cap portion 13C of 40°-60° degrees, and typically 45°. This plane embraces annular surface 13B that coacts with the outside edge 14A of conducting tube 14 to define an annular radiating gap for exchanging energy with parabolic reflector 12 after reflection from the convex inner surface 15. The periphery of the concave outside surface 13C is coextensive with the radially outermost edge of the conical reflector-facing surface 13A, and the angle formed between a line extending from this periphery to the center of the concave outside surface 13C and a plane perpendicular to the longitudinal axis of the waveguide is significantly less than the cone angle between conical reflector-facing surface 13A and a plane perpendicular to the longitudinal axis of the waveguide. By making the reflector-facing surface so that its outside boundary is a curve, such as a circular or other quartic arc, instead of a straight line, the VSWR may be reduced. The various rays pass through cap portion 13C that imparts a delay to the energy in the respective rays proportional to the path length of the respective rays through the dielectric material to provide proper illumination for parabolic reflector 12 for the desired beam width, gain and side lobe suppression. The annular gap between edge 14A and annular surface 13B is substantially at the focus of parabolic reflector 12. This annular surface 13B perpendicular to the waveguide axis is of radial width of the order of the axial distance between annular surface 13B and the top edge 14A of conducting tube 14.

Cap portion 13C is formed with a circumferential surface 13D having an axial length of the order of that of the gap between edge 14A and surface 13B. That is to say, the axial length of circumferential surface 13D is of the order of the axial distance between annular surface 13B and the top edge 14A of conducting tube 14.

End 13P of stem 13S typically defines an acute angle typically of the order of 45°.

Having described the structural arrangement of the invention, its mode of operation will be briefly described. Energy incident at the lower end is radiated by the gap between edge 14A and surface 13B essentially restricted to conducting surface 15. The convex inside surface of conducting layer 15 reflects this energy predominantly between the center and circumferential edge of parabolic reflector 12 to form a sharp pencil beam oriented along the axis. The varying path length between the gap and conducting surface 15 through cap portion 13C results in proper delay for each ray to illuminate parabolic reflector 12 with energy in the right phase to concentrate radiation along the axis while suppressing side lobes. The tapered end 13P helps provide a good impedance match over a desired frequency range so that the VSWR is maintained relatively low.

The invention has a number of advantages. It is compact, lightweight and relatively easy and inexpensive to manufacture and assemble. The compact light-weight structure negligibly shadows the parabolic reflector and negligibly increases inertia to facilitate conical or other scanning with relatively little mechanical energy. These mechanical and cost advantages are attained while enhancing electrical characteristics to such an extent that type A specifications at 18 GHz and 23 GHz may be met with a parabolic reflector only two-feet in diameter whereas a typical prior art approach requires a more costly significantly larger assembly having a four-foot reflector.

In a specific embodiment of the invention for use at 23 GHz with a conducting tube 14 of 0.40 inches in inside diameter, dielectric waveguide 13 was made of Rexolite with stem 13S 2.85 inches long, 0.40 inches in diameter, point 13P $\frac{3}{4}''$ long, the annular width of surface 13B was substantially 0.20", the axial length of circumferential surface 13D was substantially 3/16", the diameter of cap portion 13C was substantially 2.40", the axial separation between the minimum of conducting surface 15 and its edge was substantially 0.15" and the axial distance between that circumferential edge and annular surface 13B substantially 0.72".

The electrical characteristics of this structure produced a gain of 40 db, beam width of 1.6 degrees on axis, side lobes 23 db down from the main lobe and VSWR less than 1.3 over a bandwidth of 1.0 GHz at a center frequency of substantially 23 GHz without a shroud. A shroud further suppresses the side lobes.

There has been described novel apparatus and techniques for backfire feeding an antenna characterized by numerous mechanical, electrical and cost advantages. It is evident that those skilled in the art may now make numerous uses and modifications of and departures from the specific embodiment described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. In a backfire feed antenna having a parabolic reflector and a conducting tube coacting to define with a dielectric waveguide an annular gap substantially at the focus of said parabolic reflector, the improved dielectric waveguide comprising, contiguous stem and cap portions with the cap portion having a concave outside surface symmetrical about the longitudinal axis of the waveguide and formed with a conical outside surface forming a cone angle with a plane perpendicular to said longitudinal axis within the range of 40°–60° with the periphery of said concave outside surface coextensive with the radially outermost edge of said conical outside surface and the angle formed between a line extending from said periphery to the center of said concave outside surface and a plane perpendicular to said longitudinal axis being significantly less than said cone angle, said concave outside surface being coated with conducting material and coacting with said cap portion to comprise means for reflecting energy between said annular gap and said parabolic reflector so that gap rays of energy radiated by said gap illuminate said parabolic reflector between the center thereof and circumferential edge thereof to form a sharp pencil beam oriented along said longitudinal axis with the varying path length between said gap and the coated concave outside surface through said cap portion furnishing the proper delay for each ray to illuminate said parabolic reflector with energy rays relatively phased to concentrate radiation along said longitudinal axis while suppressing side lobes.

2. The improvement in accordance with claim 1 wherein the boundary between said cap portion and a stem portion of said dielectric waveguide comprises an annular surface perpendicular to said longitudinal axis of radial width of the order of the axial distance between said annular surface and said conducting tube.

3. The improvement in accordance with claim 2 wherein said cap portion has a circumferential surface contiguous with said conical surface of axial length of the order of said axial distance between the said annular surface and said conducting tube.

4. The improvement in accordance with claim 2 wherein said cap portion has a circumferential surface contiguous with said conical surface of axial length of the order of said axial distance between the said annular surface and said conducting tube.

5. The improvement in accordance with claim 1 wherein nearly the entire length of said stem portion is seated in said conducting tube.

6. The improvement in accordance with claim 5 wherein the end of said stem portion inside said conducting tube is pointed.

7. The improvement in accordance with claim 3 wherein nearly the entire length of said stem portion is seated in said conducting tube.

8. The improvement in accordance with claim 7 wherein the end of said stem portion inside said conducting tube is pointed.

* * * * *